United States Patent [19]

Cartier

[11] 4,449,383

[45] May 22, 1984

[54] COMBINATION LID AND EXCURSION SWITCH AND ALARM FOR AUTOMATIC WASHERS

[75] Inventor: Roger J. Cartier, Benton Harbor, Mich.

[73] Assignee: Whirlpool Corporation, Benton Harbor, Mich.

[21] Appl. No.: 380,087

[22] Filed: May 20, 1982

[51] Int. Cl.[3] ..... D06F 23/04; D06F 33/02; D06F 37/42

[52] U.S. Cl. ..... 68/12 R; 68/23.3; 210/144

[58] Field of Search ..... 68/12 R, 23.3, 23 R; 210/144; 200/61.62

[56] References Cited

U.S. PATENT DOCUMENTS

| | | | |
|---|---|---|---|
| 2,882,360 | 4/1959 | Sisson . | |
| 2,895,023 | 7/1959 | Blum . | |
| 3,145,818 | 8/1964 | Stelli | 210/144 X |
| 3,149,212 | 9/1964 | Smith . | |
| 3,488,463 | 1/1970 | Mellinger | 200/61.76 |
| 3,590,605 | 7/1971 | Low | 68/23 |
| 3,736,772 | 6/1973 | Baker | 68/12 R |
| 3,763,670 | 10/1973 | Harrold . | |
| 3,803,881 | 4/1974 | Getz et al. | 68/12 R |
| 3,997,751 | 12/1976 | McNally | 68/12 R |
| 4,098,098 | 7/1978 | Altnau | 68/23 |

FOREIGN PATENT DOCUMENTS

| | | | |
|---|---|---|---|
| 136760 | 10/1979 | Japan | 68/12 R |

*Primary Examiner*—Philip R. Coe
*Assistant Examiner*—Frankie L. Stinson
*Attorney, Agent, or Firm*—Hill, Van Santen, Steadman & Simpson

[57] ABSTRACT

A combination lid and excursion switch and alarm for automatic washers is provided in which the opening of the lid or excursion of the tub due to an imbalance in the load during the spin cycle causes an interruption of power to the washer motor. An imbalance in the load would also sound an audible signal. The switching mechanism is automatically reset by the opening and reclosing of the lid.

9 Claims, 11 Drawing Figures

COMBINATION LID AND EXCURSION SWITCH AND ALARM FOR AUTOMATIC WASHERS

BACKGROUND OF THE INVENTION

1. Field of the Invention

This invention relates to the use of a combination lid and off-balance switch mechanism in an automatic washer to provide various signals and control functions during the course of a washing cycle.

2. The Prior Art

U.S. Pat. No. 2,882,360 discloses a combined lid and off-balance switch which utilizes a lever arm that is moved horizontally by the closing of the lid to actuate a switch and which is moved vertically by a second lever arm to deactivate the switch whenever sufficient movement of the tub occurs.

Other combined off-balance and lid switches are shown in U.S. Pat. Nos. 3,149,212 and 3,763,670.

SUMMARY OF THE INVENTION

The present invention utilizes a combination lid and off-balance switch mechanism in conjunction with a buzzer and timer to turn the automatic washing machine off when the lid is open during spin, to give an audible indication of load unbalance and to turn off the machine due to that load unbalance, and to provide an end of cycle signal. The switching mechanism is reset when the washer lid is opened and reclosed.

DESCRIPTION OF THE PREFERRED EMBODIMENTS

Figure 1:
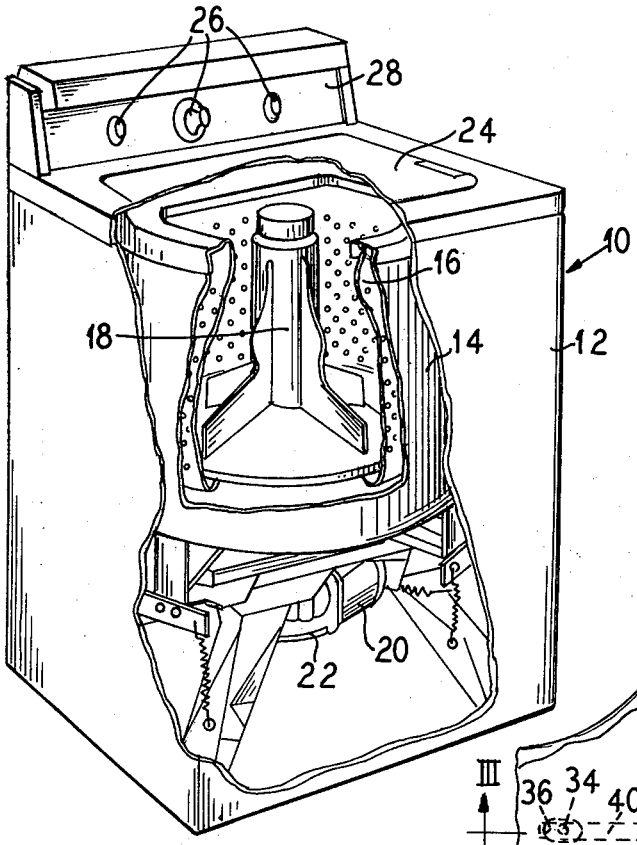
FIG. 1 is a perspective view of a washing machine partially cut away to show the interior mechanism.

In FIG. 1 an automatic washing machine is shown generally at 10 comprising a cabinet or housing 12, an imperforate tub 14, a concentrically mounted basket 16 with a vertical agitator 18, a water supply (not shown), an electrically driven motor 20 operably connected via a transmission 22 to the agitator 18.

An openable lid 24 is provided on the top of the cabinet 12 and controls 26 including a presettable sequential control means for use in selectively operating the washing machine through a programmed sequence of washing, rinsing and drying steps are provided on a console panel 28.

Figure 2:
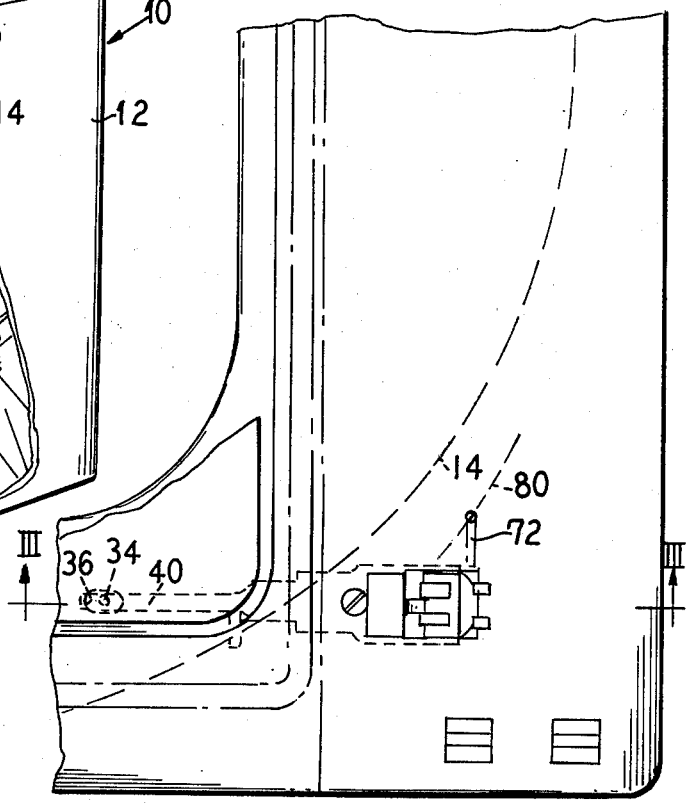
FIG. 2 is a partial top elevational view of the washing machine of FIG. 1 showing the location of the switching mechanism in phantom.
Figure 3:
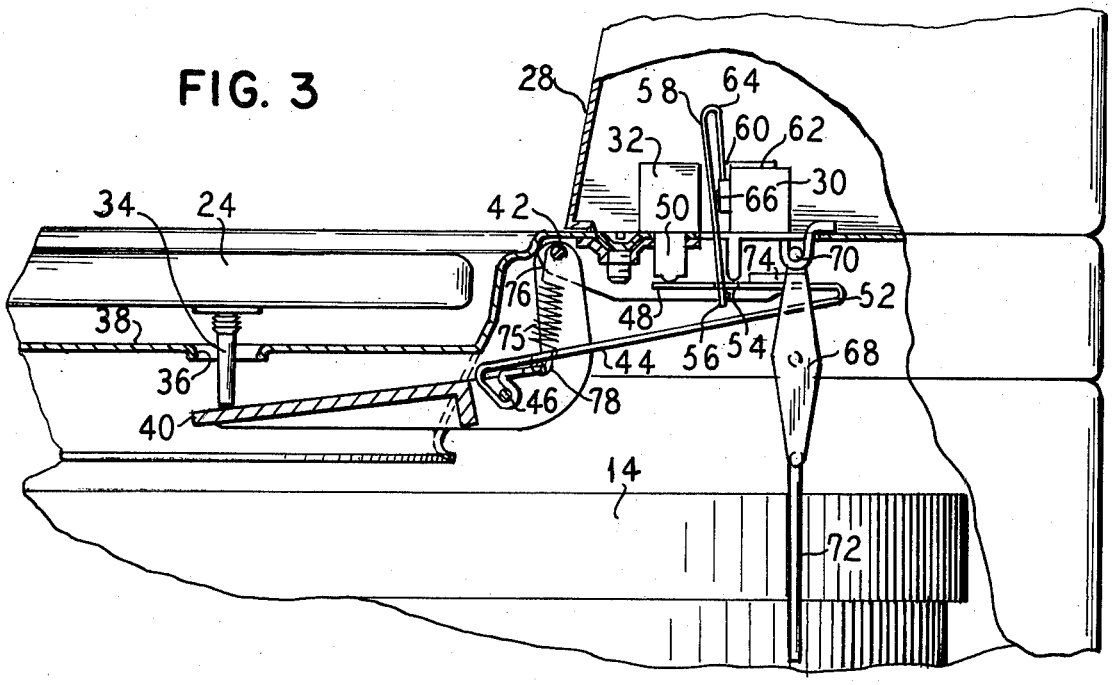
FIG. 3 is a partial side sectional view of the switching mechanism of the invention taken generally along the lines III—III of FIG. 2.

In FIGS. 2 and 3 there is shown in detail the switching mechanism of the present invention which includes a first switch 30 and a second switch 32 mounted within the console portion 28 of the automatic washer 10 which is outside the harsh environment associated with an area adjacent the washer tub and basket.

The lid 24 has a plunger 34 mounted thereon which projects through an opening 36 in a top wall 38 of the washer cabinet 12. When the lid 24 is in the closed position, the plunger 34 contacts a paddle 40 which is pivotally attached to the cabinet by means of pivot pin 42. A bracket lever 44 is secured at a first end 46 to move with the paddle 40 and has a second end 48 which contacts and depresses the plunger 50 of the second switch 32. The second end 48 is doubled back toward the first end 46 of the bracket lever 44 forming a bight 52 between the ends which provides some flexibility and resiliency to the bracket lever 44.

The portion of bracket lever 44 between the second end 48 and the bight 52 has a central opening 54 therethrough to receive a first end 56 of a spring actuator 58. The end 56 protrudes slightly through the opening 54. A second end 60 of the spring actuator 58 is secured to a housing 62 of the first switch 30. A bight 64 is formed between the first and second ends of the spring actuator 58 to provide resiliency to the actuator. A portion of the spring actuator 58 between the first end 56 and the bight 64 contacts and depresses a plunger 66 of the first switch 30 when the first end 56 is captured in the opening 54 of the bracket lever 44 and when the paddle 40 is depressed by the plunger 34 with the lid 24 in the closed position.

A trigger 68 is pivotally mounted at 70 in a generally vertical position and has a perpendicularly protruding finger 72 which extends toward the tub 14. The trigger 68 has a perpendicularly disposed arm 74 which rests on a top surface of the portion of the bracket lever 44 between the second end 48 and the bight 52.

A spring 75 is attached at a first end 76 to the pivot pin 42 about which the paddle 40 rotates and at a second end 78 to a position on the paddle 40 so as to bias the paddle 40 in an upwardly direction.

Figure 4:
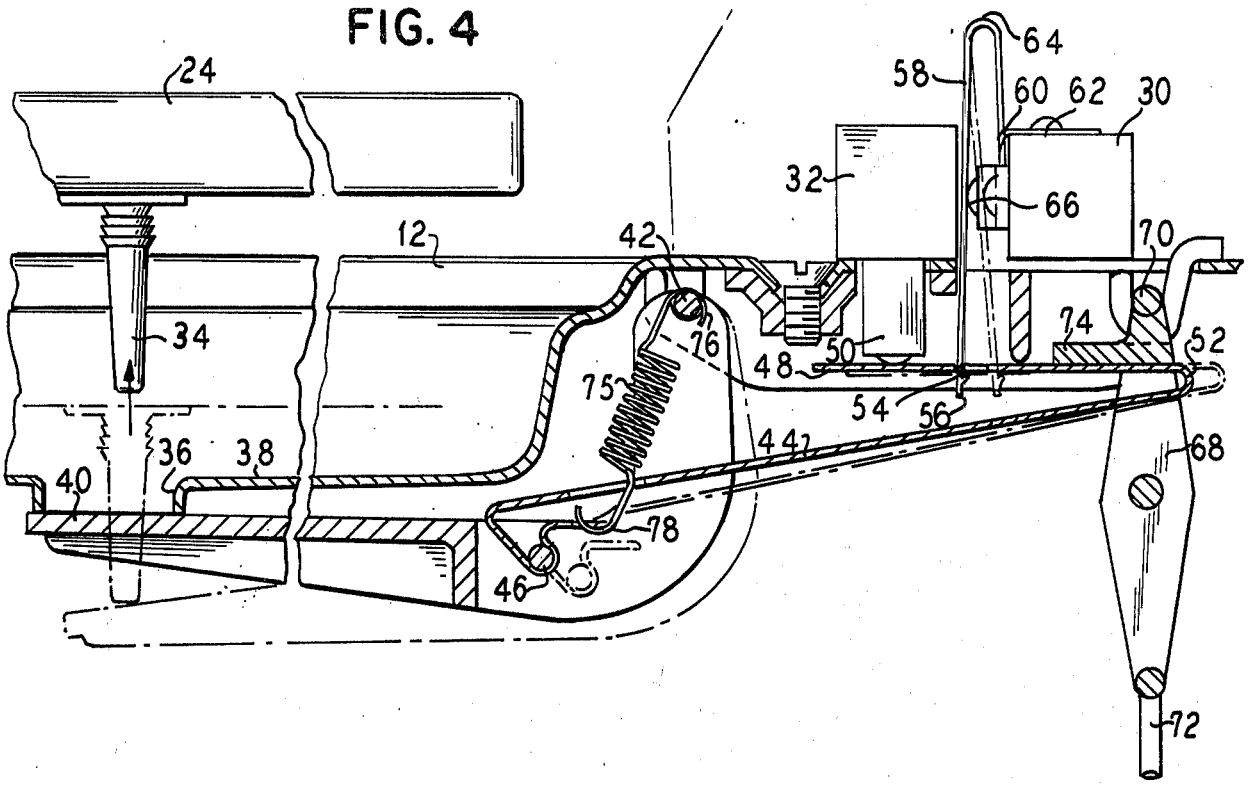
FIG. 4 is a partial side sectional view of the switching mechanism showing the mechanism in the open lid position.
Figure 5:
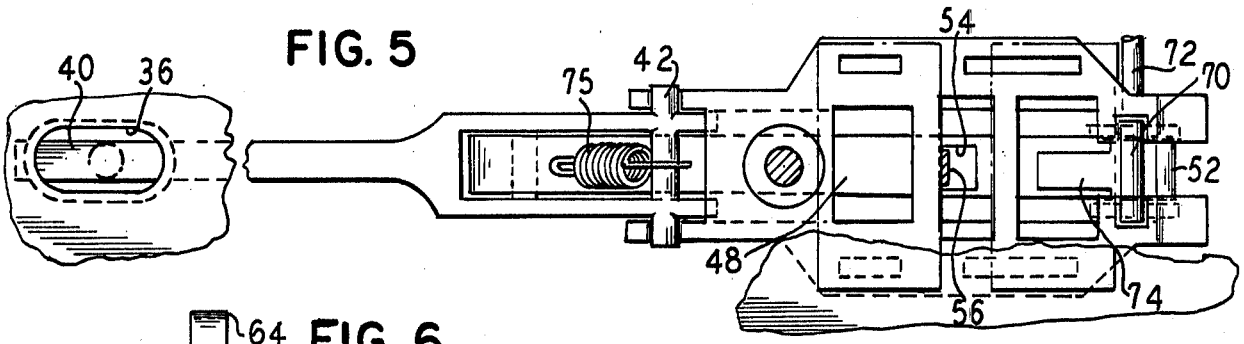
FIG. 5 is a partial top elevational view of the switching mechanism shown in FIG. 4.
Figure 6:
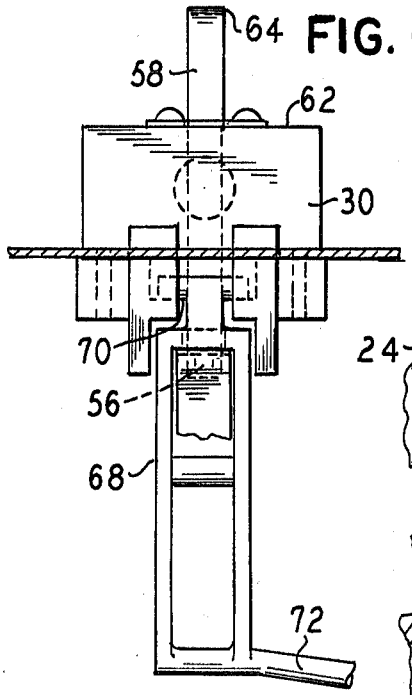
FIG. 6 is an end view of the switching mechanism shown in FIGS. 4 and 5.

The operation of the mechanism when the lid is opened is shown in FIGS. 4, 5 and 6 wherein the opened lid 24 is shown in the full line drawing and the closed lid position is shown in phantom. When the lid 24 is open, the plunger 34 moves away from the paddle 40 and the spring 75 causes the paddle to move upwardly until it makes contact with the opening 36 in the top wall 38 of the washer cabinet 12. As this happens, the paddle 40 rotates about pivot pin 42 which in turn displaces the bracket lever 44 to the left as shown in the orientation of FIG. 4. As the bracket lever 44 follows the rotation of the paddle 40, the position of the opening 54 in the bracket lever 44 also shifts thereby allowing the spring actuator 58 to relax somewhat and to release the plunger 66 of the second switch 30.

In the spin portion of the washing cycle, the switch 30 provides energization to the motor 20 when the plunger 66 is depressed. When the plunger 66 is released, power to the motor 20 is interrupted and the washer is de-energized. Thus, the opening of the lid 24 during the spin portion of the washing cycle results in de-energization of the washer and stops the basket from spinning. When the lid is returned to the closed position, as is shown in FIG. 3, the plunger 66 is again depressed by the spring actuator 58 and re-energizes the motor 20 thereby continuing the spin portion of the washing cycle.

The second end 48 of the bracket lever 44 remains in contact and continually depresses the plunger 50 of the second switch 32 even when the lid is in the opened position. Thus, the opening of the lid during the spin cycle has no effect on the state of the second switch.

Figure 7:
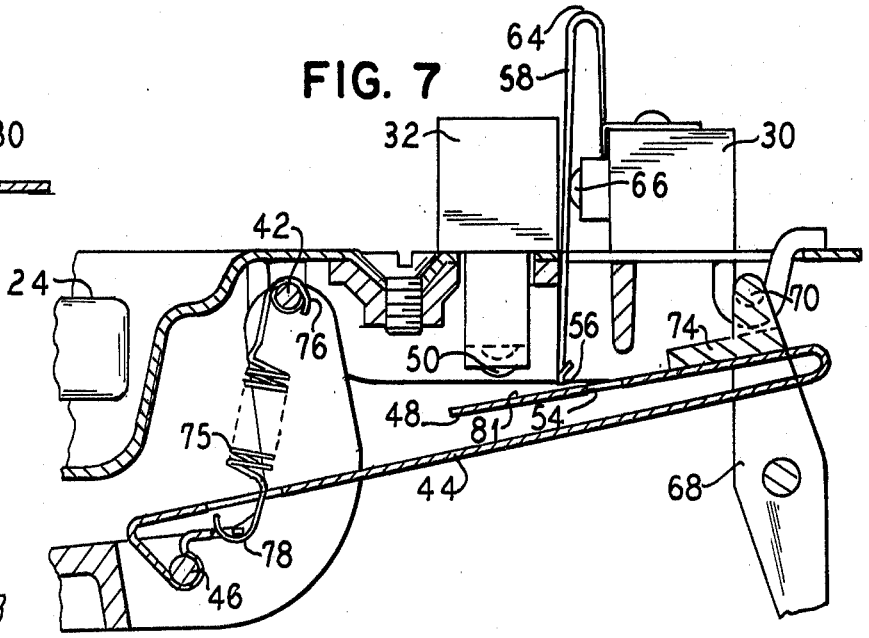
FIG. 7 is a partial side sectional view of the switching mechanism in the off-balance position.

FIG. 7 shows the operation of the mechanism when an unbalance occurs in the wash tub during the spin cycle. As seen in phantom in FIG. 2, the perpendicular finger 72 projects toward the tub 14. If the load in the tub is off-balanced, the tub will begin to oscillate during the spin cycle and if too great of an oscillation occurs, there could be damage to the machine. If the imbalance causes the tub to move out to the position shown by dashed lines 80 in FIG. 2, this would result in finger 72 being pushed outwardly causing the trigger 68 to pivot about pin 70 as shown in FIG. 7.

When this occurs, the perpendicular arm 74 depresses the bracket lever 44 against the bias of spring 75 and the resiliency of the bracket lever, allowing the end 56 of spring actuator 58 to become disengaged from the opening 54 in the lever 44. As the arm 74 depresses the bracket lever 44, the second end 48 moves away from the plunger 50 of the second switch 32 and thereby disengages the plunger 50 allowing it to move outwardly. Also, when the spring actuator 58 becomes disengaged from the opening 54 in the bracket lever 44 it moves outwardly away from the plunger 66 of the switch 30 and thereby disengages the plunger 66. In this manner, both switches 30 and 32 are deactivated when the trigger 68 is pivoted by the off-balance of the tub.

As described above, the first switch 30 controls the supply of power to the motor 20 and thus when the tub reaches a critical off-balance condition, the motor 20 is de-energized and the basket ceases to rotate. The switch 32 controls an audible buzzer which is activated upon the disengagement of the switch 32. Thus, when the tub 14 oscillates to a critical degree, the power is removed from the motor 20 and an audible signal is produced.

The second end 48 of the bracket lever 44 will remain in the depressed position, even after the trigger 68 resumes its original position, because the end 56 of the spring actuator 58 will be in contact with a top surface 81 of the bracket lever 44. Thus, the audible alarm buzzer activated by switch 32 will sound continuously. The entire mechanism can be reset by opening the lid 24 which causes the bracket lever 44 to shift to the left as described above, thereby lining up the opening 54 with the end 56 of the spring actuator 58 as shown in FIG. 4. When this occurs, the end 56 drops through the opening and the end 48 of the bracket lever 44 is free to move upwardly to depress plunger 50 and thereby turn off the buzzer alarm. The mechanism will then be in the position shown in full lines in FIG. 4. Upon reclosing the lid 24, the entire mechanism would be reset and power to the motor 20 would be reconnected.

Figure 8:
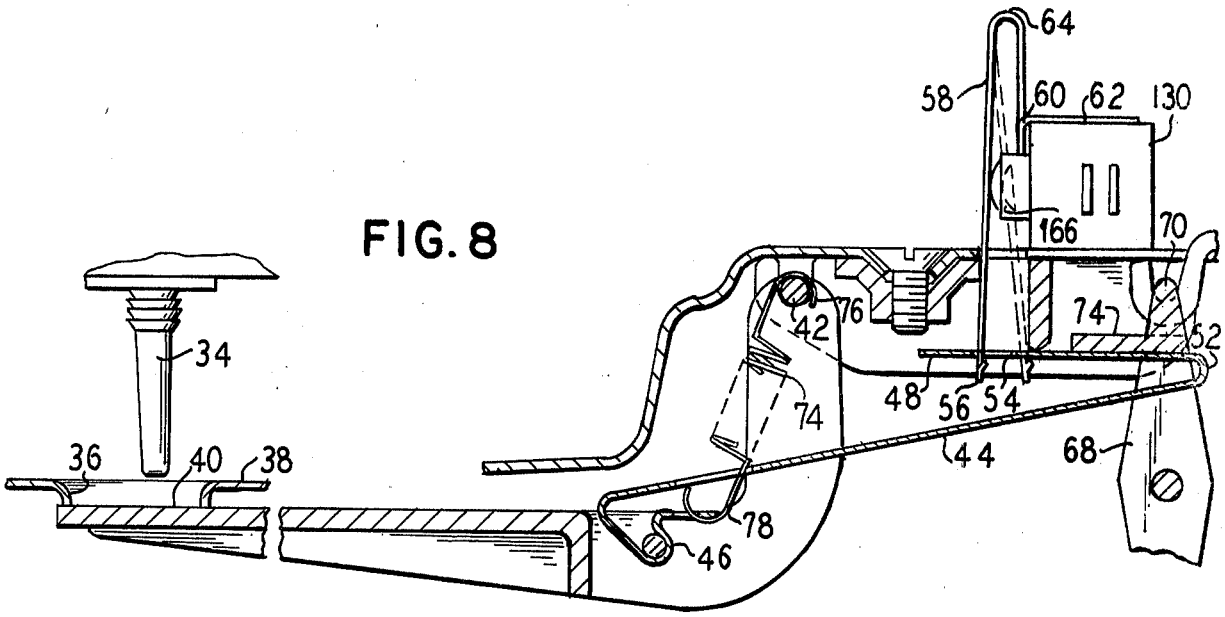
FIG. 8 is a partial side sectional view of an alternative embodiment of the switching mechanism.
Figure 9:
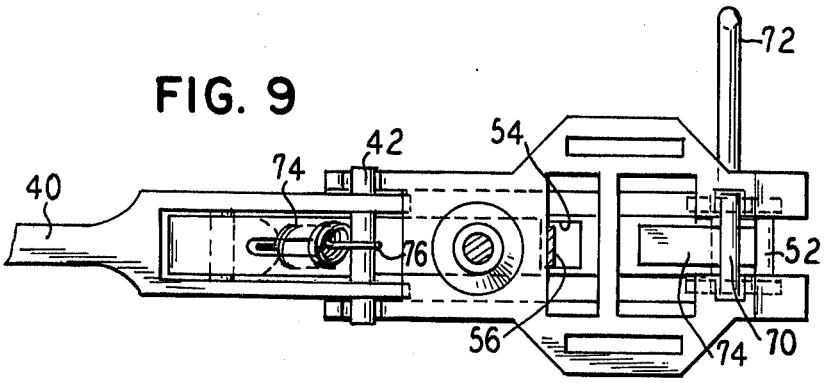
FIG. 9 is a partial top elevational view of the switching mechanism shown in FIG. 8.
Figure 10:
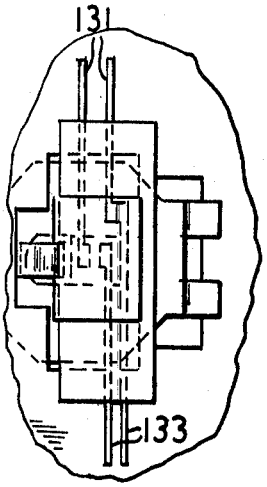
FIG. 10 is a partial end view of the switching mechanism shown in FIGS. 8 and 9.

FIGS. 8, 9 and 10 show a second embodiment of the present invention which is identical in all respects to the first embodiment shown in FIGS. 2 through 7 with the exception that only a single switch 130 is utilized instead of the two switches 30 and 32 of the first embodiment. The operation of the switching mechanism is the same as that in the first embodiment, however, the single switch 130 is connected via two sets of leads 131, 133 to both interrupt power to the motor and sound the audible buzzer alarm when the plunger 166 is released. Therefore, during the spin cycle, if the lid 24 is opened or if the clothes load in the tub is off-balanced, either condition will result in the de-energization of the motor and the sounding of the audible buzzer.

Figure 11:
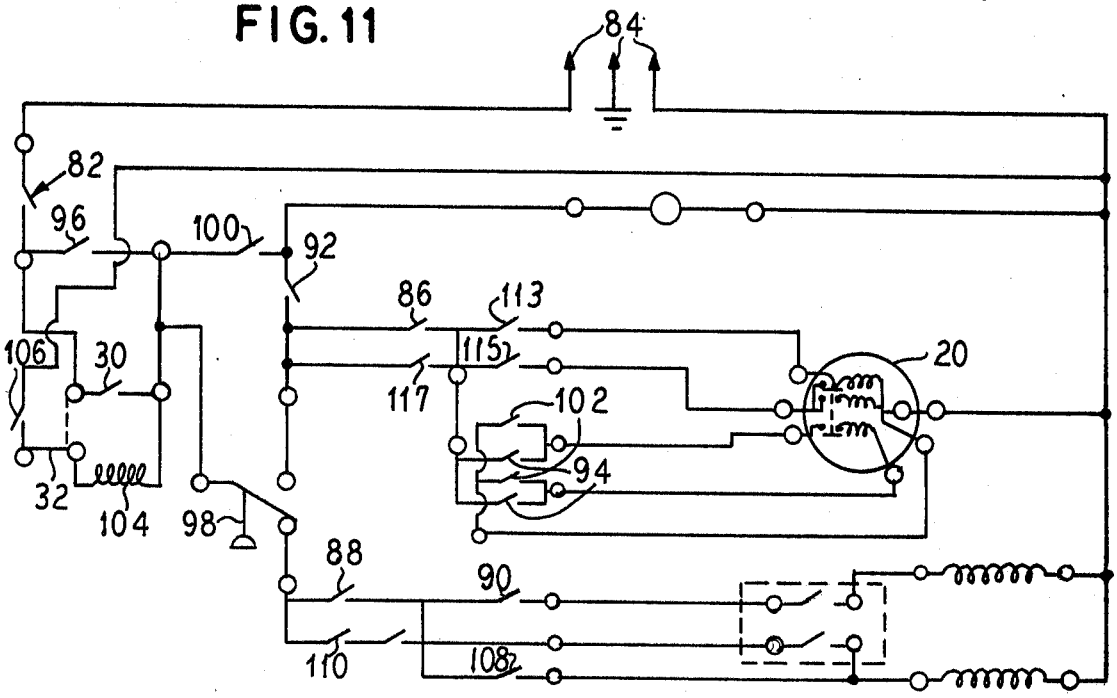
FIG. 11 is a schematic wiring diagram showing the electrical circuitry associated with the switching mechanism.

FIG. 11 shows a schematic wiring diagram for the automatic washer.

In the typical cycle of operation, the washing machine is connected through a push-pull timer knob switch 82 to an electrical source 84 when the timer knob is pulled. In the normal cycle, switch 86 and fill switches 88 and 90, timer switch 92, motor agitate switch 94, and lid switch by-pass 96 are all closed. The machine is thus under the control of the water level switch 98 until it switches from the low to the full position, deactivating the water fill valves and activating the timer motor. The switches remain activated until the drain cycle is started, at which time the timer motor by-pass switch 100 is closed allowing the machine to drain and lid switch by-pass 96 is opened.

The motor spin switch 102 is closed after the opening of the motor agitate switch 94 which reverses the motor direction. This causes the machine to go into a spin cycle. The opening of lid switch by-pass 96 activates the lid switch and off-balance buzzer mechanism during the spin cycle. Thus, if the lid is opened, the lid switch 30 opens deactivating the appliance. If an off-balance occurs, the lid switch 30 is opened deactivating the machine and the second switch 32 moves into the dashed line position to connect the buzzer circuits 104 and sound the audible alarm.

At the end of the spin cycle, the machine is again filled, agitated for rinse and then spun again. At the end of the last spin, the end of cycle timer cam operated switch 106 is closed for a short period of time to sound the buzzer 104. The temperature of the water is operated and selected from the console and cam operated switches 88, 90, 108 and 110 control the allowable temperatures in the various wash and rinse cycles with switch 110 controlling spray rinses which are activated during the spin cycle. Switches 113 and 115 determine whether a high or low speed is utilized during the cycle. Switches 110 and 117 are sub-interval switches which are utilized to provide short intermittent operation of the cam switches.

For the second embodiment shown in FIGS. 8, 9 and 10, switch contacts 108 are normally closed and the end of cycle signal is provided by operation of switch 106.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic washer having a cabinet housing a basket for containing clothes to be washed and centrifugally dried, a lid for the cabinet providing access to the basket, a motor and transmission means for washing the clothes in the basket and for spinning the basket to centrifugally dry the clothes, a sequential control means providing a sequence of operation of the washer through a clothes washing cycle, an alarm means for indicating a condition of the automatic washer, a source of power connectable to said automatic washer including said sequential control means, and an interruption control means for interrupting the sequence of operation of said automatic washer, said interruption means comprising:

first switch means operable in a first state to disconnect power from said sequential control means during a portion of the washing cycle;

second switch means operable in a first state to sound said alarm means, a lid and off-balance mechanism interconnecting both switch means comprising:

a pivotable lever means, a depending pivotable finger means, a bracket lever means, and a spring actuator means, said mechanism interconnected to said lid by means of a protrusion from said lid overlying and pivoting said pivotable lever when said lid is closed, said mechanism interconnected to said basket through said finger which is caused to pivot during an off-balance condition of said basket, said bracket lever secured at a first end to said pivotable lever and being movable therewith, a second end of said bracket lever contacting and baising said second switch into a second state and having a releasable connection with said spring actuator, said spring actuator being held against and baising said first switch into a second state by said bracket lever when said lid is in a closed position, and being moved away from and releasing said first switch into said first state when said lid is in an open position, said finger having a portion engagable with said bracket lever when said finger is pivoted causing said second end of said bracket lever to move away from and release said second switch into said first state and to release its connection with said actuator spring thereby releasing said first switch to said first state, whereby, opening said lid causes a change of state of only said first switch and an off-balance condition causes a change of state of both said first and second switches.

2. An interruption control means with an audible alarm means for use with an appliance having an openable door and a power driven load carrying rotatable member susceptible to rotating in an off-balance manner comprising:

first switch means operable in a first state to disconnect power from said rotatable member;

second switch means operable in a first state to sound said alarm means;

a detection mechanism interconnecting said first and second switch means comprising a first lever means and a second lever means, said first lever means normally biasing said second switch means into a second state and being acted upon by said door to bias said first switch means into a second state when said door is closed and to release said first switch means into said first state when said door is open;

said second lever means acted upon by said rotatable member during an off-balance condition to in turn act upon said first lever means to release said first and second switch means to their respective first states.

3. For use in an automatic washer having a cabinet housing a basket for receiving clothes to be washed and centrifugally dried, a lid for the cabinet providing access to the basket, a motor and transmission means for washing the clothes in the basket, and for spinning the basket to centrifugally dry the clothes, an audible alarm means for indicating a condition of said washer, a source of power connectable to said automatic washer, and an interruption control means for interrupting the power to said motor, said interruption means comprising:

first switch means operable in a first state to disconnect power from said motor;

second switch means operable in a first state to sound said alarm means, a detection mechanism interconnecting both switch means comprising:

a depending pivotable finger means, a bracket lever means, and a spring actuator means, said bracket lever means responsive to the open and closed position of said lid, having a portion normally biasing said second switch into a second state and having a releasable connection with said spring actuator means, said spring actuator means moved by said bracket lever means to bias said first switch into a second state when said lid is in a closed position and releasing said first switch into said first state when said lid is in an open position, said finger means pivotally responsive to an off-balance condition of said basket having a portion engagable with said bracket lever means when said finger is pivoted causing said second end of said bracket lever to release its connection with said actuator spring means thereby releasing said first switch to said first state, and to release said second switch into said first state, whereby, opening said lid causes a change of state of only said first switch and an off-balance condition causes a change of state of both said first and second switches.

4. The automatic washer of claim 1, wherein said mechanism remains in a moved position caused by said off-balance condition until said lid is opened and then closed which operates to automatically reset both switch means to their respective second positions.

5. The interruption control means of claim 2, wherein said mechanism remains in a moved position caused by said off-balance condition until said door is opened and then closed which operates to automatically reset said interruption control means to a non-off-balance load position.

6. The automatic washer of claim 3, including sequential control means providing a sequence of operation of the washer through a clothes washing cycle whereby said first switch means is operable to disconnect power from said sequential control means during a portion of the washing cycle.

7. The automatic washer of claim 6, wherein said first and second switch means are operable to disconnect power and sound said alarm only when said washer is in a spin portion of said washing cycle.

8. The automatic washer of claim 3, wherein said detection mechanism remains in a moved position caused by said off-balance load until said lid is opened and then closed which operates to automatically reset said mechanism to a non-off-balance load position.

9. The device of claim 3, wherein said washer has a console portion and said switch means are located in said console.

* * * * *